US006976346B2

(12) United States Patent
May et al.

(10) Patent No.: US 6,976,346 B2
(45) Date of Patent: Dec. 20, 2005

(54) AUTOMATIC NETTING PACKAGING MACHINE

(75) Inventors: Dennis J. May, Pittsboro, NC (US); Samuel D. Griggs, Raleigh, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/725,109

(22) Filed: Dec. 1, 2003

(65) Prior Publication Data

US 2004/0250512 A1 Dec. 16, 2004

Related U.S. Application Data

(60) Provisional application No. 60/478,077, filed on Jun. 12, 2003.

(51) Int. Cl.[7] ..... B65B 9/15; B65B 5/04; B65B 61/04

(52) U.S. Cl. ..... 53/134.1; 53/138.4; 53/576

(58) Field of Search ..... 53/417, 430, 134.1, 53/138.4, 567, 576; 29/243.57

(56) References Cited

U.S. PATENT DOCUMENTS

| | | | | |
|---|---|---|---|---|
| 3,383,754 A | | 5/1968 | Klenz | |
| 3,389,533 A | | 6/1968 | Tipper et al. | |
| 3,499,259 A | * | 3/1970 | Marietta, Jr. et al. | 53/417 |
| 3,763,621 A | * | 10/1973 | Klein et al. | 53/530 |
| 3,815,323 A | * | 6/1974 | Longo | 53/530 |
| 4,044,450 A | | 8/1977 | Raudys et al. | |
| 4,165,593 A | | 8/1979 | Niedecker | |
| 4,247,005 A | | 1/1981 | Buxton | |
| 4,537,006 A | | 8/1985 | Pieri | |
| 4,675,945 A | * | 6/1987 | Evans et al. | 53/138.4 |

(Continued)

FOREIGN PATENT DOCUMENTS

FR 2 463 059 2/1981

OTHER PUBLICATIONS

Tipper Tie Whole Bird Packaging System; www. tipper-tie.com/poultry/tb10.asp.

(Continued)

*Primary Examiner*—John Sipos
(74) *Attorney, Agent, or Firm*—Banner & Witcoff, Ltd.

(57) ABSTRACT

Knitted netting is applied to products in a machine. A chute receives products serially through a receiving end, as from a conveyor, and discharges them serially into netting preferably rucked on the chute. As each product arrives at the product receiver, voiders operate to form a rope section of the netting behind the product, at the chute's discharge end. The clipper also clips the netting, to complete the netting of the product, and clips to create the starting end of the next netted product. A netting handle former operates to loop the rope section behind the product, before clipping, to form a looped handle for a product in the rope section of the netting. The netting that is clipped behind the products is the netting formed into the loops, and thus, the clips that are put on by the clipper secure the loops in their size and condition. The product receiver is preferably a discharge tray, and product guides on the tray straighten the product, to align it for netting, and also co-operate with the voiders to help tighten the product packaging. The clipper is also preferably uniquely structured in its clip rails to contribute to tighter packaging. The chute is gravity driven and includes product ribs or rails for centering and ease of movement of products. The handle former is an essentially two-part, mechanically actuated disc and clam shell construction that reaches for the netting, captures it, and rotates a loop into it, while tightening the packaging, in co-ordination with the voiders.

12 Claims, 10 Drawing Sheets

U.S. PATENT DOCUMENTS

| | | | |
|---|---|---|---|
| 4,969,233 | A | 11/1990 | Stanley |
| 5,017,175 | A | 5/1991 | Klusmire |
| 5,042,234 | A | 8/1991 | Evans et al. |
| 5,067,313 | A | 11/1991 | Evans |
| 5,109,648 | A | 5/1992 | Evans |
| 5,165,216 | A | 11/1992 | May et al. |
| 5,476,673 | A | 12/1995 | Sombrio |
| 6,729,102 | B2 * | 5/2004 | Ailey et al. ..... 53/134.1 |

OTHER PUBLICATIONS

Tipper Tie TB15; www.tippertie.com/poultry/tb10.asp.
Tipper Tie Z3214; www.tippertie.com/poultry/z3214.asp.

* cited by examiner

FIG.10
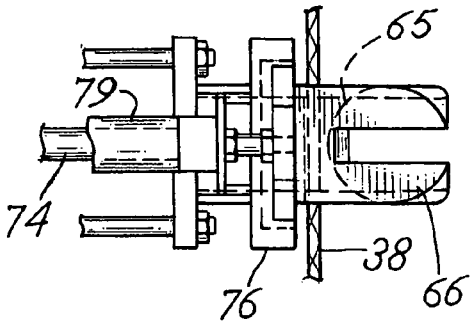
FIG.11
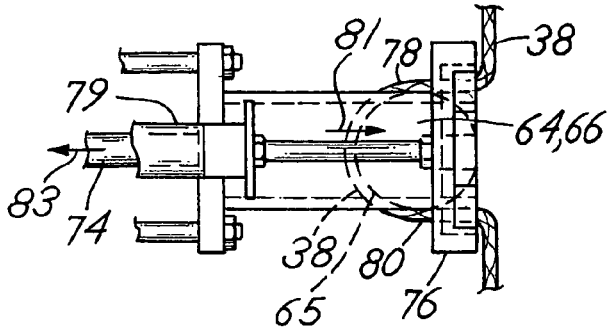
FIG.12
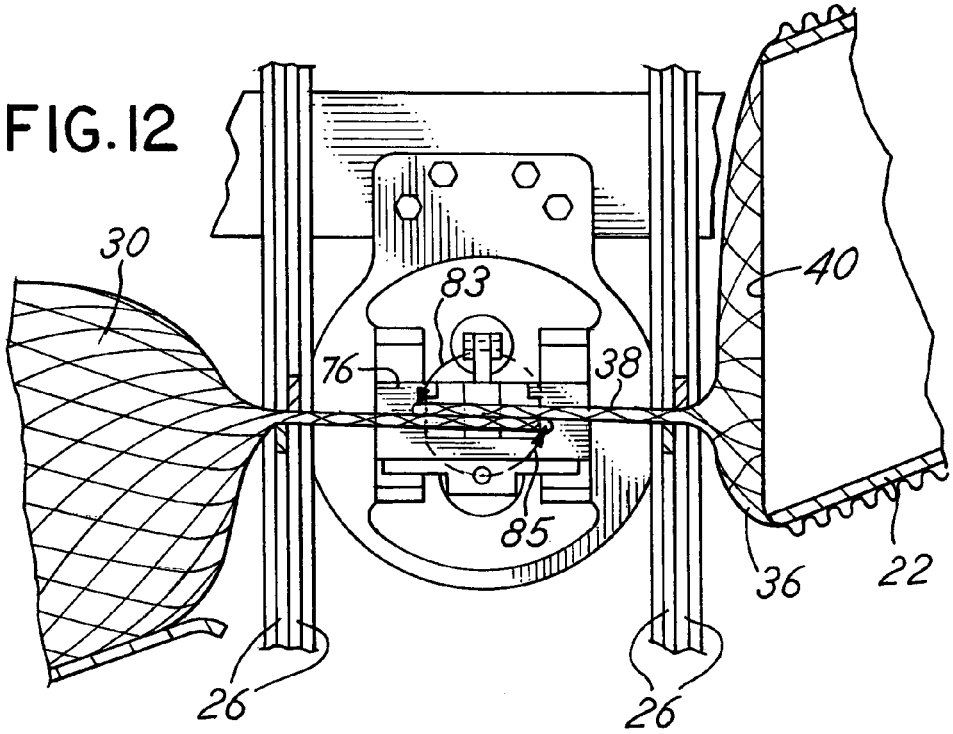
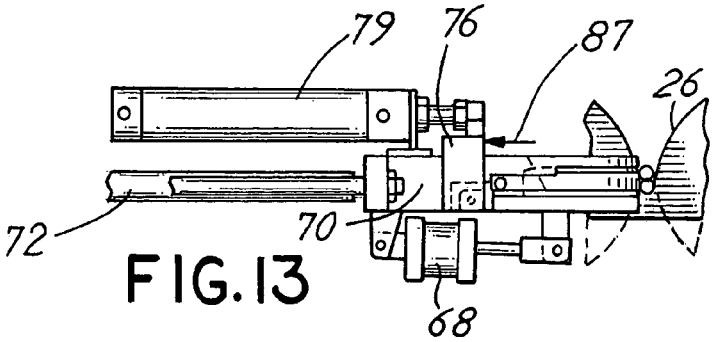
FIG.13

AUTOMATIC NETTING PACKAGING MACHINE

This application claims priority to U.S. Provisional Application Ser. No. 60/478,077, filed Jun. 12, 2003, which is incorporated herein by reference in its entirety.

BACKGROUND OF THE INVENTION

This invention relates to the packaging of net-enclosed or netted products, the machines and methods that form such products, and especially to the machines and methods that form net-enclosed turkeys and similar poultry and meat products, as well as potentially, net-enclosed firewood, bulk explosives, and other possible net-enclosed consumer and industrial products.

Knitted and extruded netting is a packaging material of choice for industries including meat and poultry, aquaculture, horticulture, Christmas tree, PVC pipe, environmental, aviation, fruit and produce, toys, housewares, and the like. Knitted netting can be soft, flexible, and conformable to a variety of irregularly shaped products. Knitted netting provides air circulation, and can be decorative and protective. Tipper Tie Inc., a Dover Industries company, makes and sells desirable netting under the trademark Net-All. In meat netting, Net-All netting is used for hams, whole birds, poultry breasts, and molded meat products.

Netting is applied to products manually, semi-automatically, and fully automatically by a variety of machines and methods including the Tipper Tie Whole Bird Packaging System, the Tipper Tie Automatic Whole Bird Packaging System, Tipper Tie Model TB15, and the Tipper Tie Clipper Model Z3214. Another Tipper Tie apparatus for applying netting is shown in U.S. Pat. No. 5,042,234, issued on Aug. 27, 1991, to Alfred J. Evans et al. for a Collagen Film and Netting Packaging System and Method. A loop forming mechanism for flexible packaging material is also shown in U.S. Pat. No. 5,165,216, issued on Nov. 24, 1992 to Dennis J. May et al., for a Loop Forming Mechanism for Flexible Packaging Material. As stated in the identified Evans et al. patent, netting is sometimes placed around products to be netted when the products exits chutes or tubes around which the netting is rucked. Machines known as clippers may place metal clips on the netting between the products, to close the netting and provide for separation of the products.

While the existing products, machines and methods of the "netting art" have great value, especially those from Tipper Tie Inc., the frontier of technology is ahead of them, to be advanced further by inventive efforts.

SUMMARY OF THE INVENTION

In a first principal aspect, this invention constitutes a product netting machine. The machine comprises, in major part, a chute, a product receiver, voiders, and a clipper. The chute receives products serially through a receiving end, as from a conveyor, and discharges them serially into netting preferably rucked on the chute. As each product arrives at the product receiver, voiders operate to form a rope section of the netting behind the product, at the chute's discharge end. The clipper also clips the netting, to complete the netting of the product, and clips to create the starting end of the next netted product. With a machine as described, products are serially or successively netted and clipped.

In another principal aspect, the invention constitutes a machine as described, with a netting handle former. This former operates to loop the rope section behind the product, before clipping, to form a looped handle for a product in the rope section of the netting. The netting that is clipped behind the products is the netting formed into the loops, and thus, the clips that are put on by the clipper secure the loops in their size and condition.

In a third principal aspect, the invention constitutes a machine as described, with a number of valuable mechanisms, components and structures. As an example, the product receiver is preferably a discharge tray, and product guides on the tray straighten the product, to align it for netting, and also co-operate with the voiders to help tighten the product packaging. As another example, the clipper also preferably is uniquely structured in its clip rails to contribute to tighter packaging. As a third example, the chute is gravity driven and includes product ribs or rails for centering and ease of movement of products. As a fourth example, the handle former is an essentially two-part, mechanically actuated disc and clam shell construction that reaches for the netting, captures it, and rotates a loop into it, while tightening the packaging, in co-ordination with the voiders.

In a fourth aspect, the invention also constitutes the unique elements of the clipper.

In a fifth aspect, then, the invention constitutes a method of product netting. This method comprises moving products, preferably serially, through a chute into netting to enclose the product and begin the method of netting the product. The netting material is then voided behind the product to form the rope section as described with the machine, and the material is clipped, also as described with the machine.

In a preferred sixth aspect of the invention, the method includes forming the loop handle of the rope section and clipping the loop to form a secure, looped handle for a product, and a tight net package for the product as well.

In a seventh aspect, the invention comprises the netted, handled, clipped product itself, and such products that are also potentially further weighed and tagged.

As hopefully apparent, a first object of the invention is to substantially advance the art of netting machines and methods, pushing back the frontiers of this technology, for broader, more satisfactory application of the technology in a variety of uses.

Another set of objects is to apply netting to products essentially automatically, reliably, and at high speed, where the products include whole turkeys, hams, shellfish, and similar items in a variety of industries. The netting may be placed directly over the products or over wrapping over the products.

A third set of objects of the invention is to weigh, potentially tag, bag, and provide consistently sized consumer handles for better-looking finished products, in series, in safe and efficient netting machines, through sophisticated netting application methods.

A fourth set of objects of the invention is to provide a netting machine of easy operation by one person, capable of use with an large assortment of netting, with all electronic controls, constructed of stainless steel, meeting USDA requirements, suitable for harsh environments, and washable for sanitation.

All these and other objects and advantages of the invention are better understood by a study of the detailed description of the preferred embodiments of the invention, which follows after a brief description of the drawing.

BRIEF DESCRIPTION OF THE DRAWING

The accompanying drawing illustrates the specific preferred embodiment of the machine of the invention. Familiarity with the machines of the prior art is assumed. The structure shown in the drawing is not the only form that the invention as claimed may take. The drawing and the following detailed description of the preferred embodiment are intended to limit the claims only as consistent with the law of claim interpretation, whereby claims are interpreted in light of the specification and drawing.

The description which follows may refer to the componentry of the machine in such spatial terms as "forward," front," "rear," "upper," "lower," "left," "right," "behind," "downstream," etc. Terms such as these, which depend on the specific spatial orientation of the components, are intended for the aid of the reader, and except as incorporated into the claims, they are not intended as a limitation on the possible orientation of components in any possible alternate, but covered, embodiment of the invention. Except as consistent with the law of claim interpretation, the drawing and following description are only illustrative of the invention.

Figure 1:
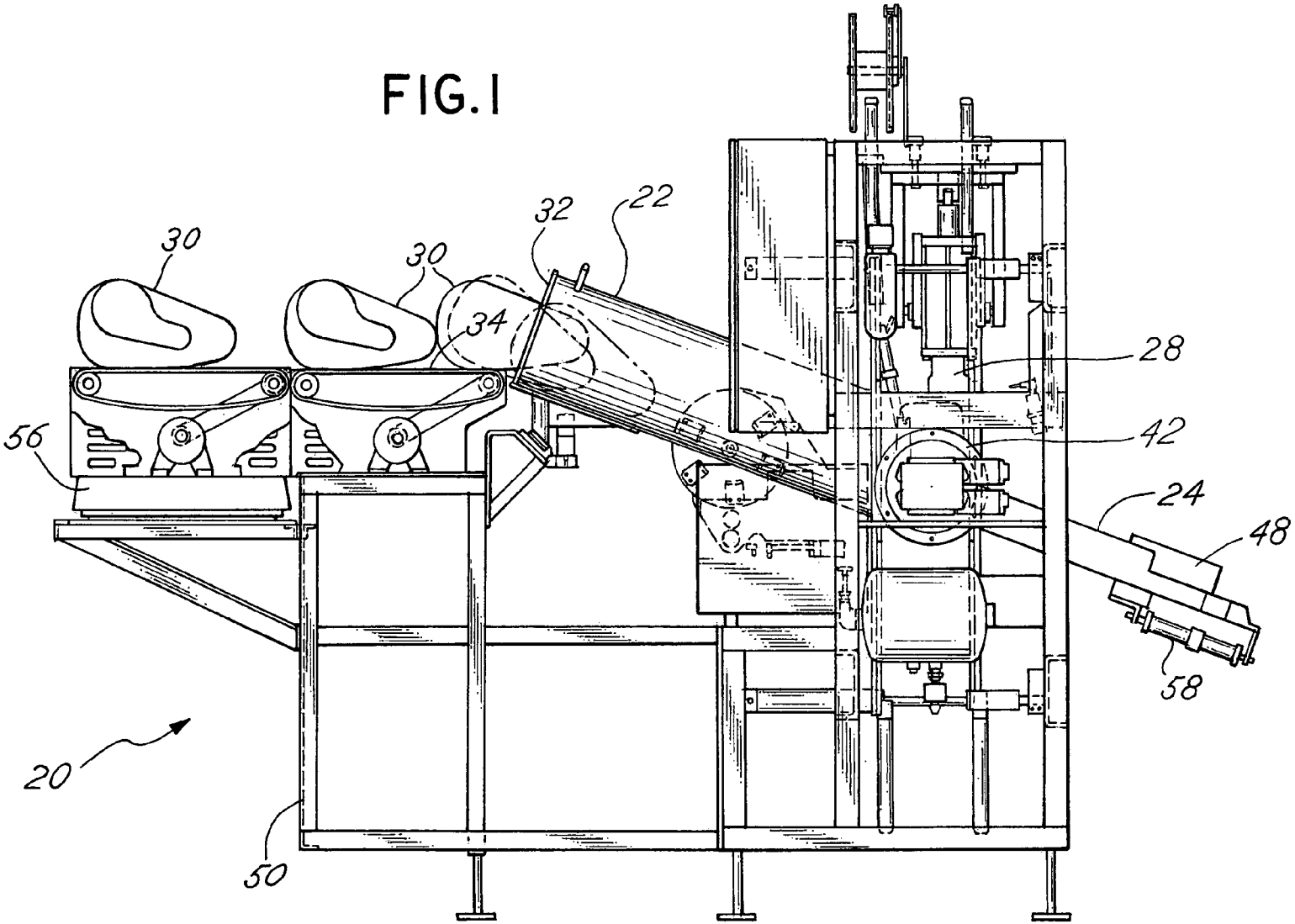
Figure 2:
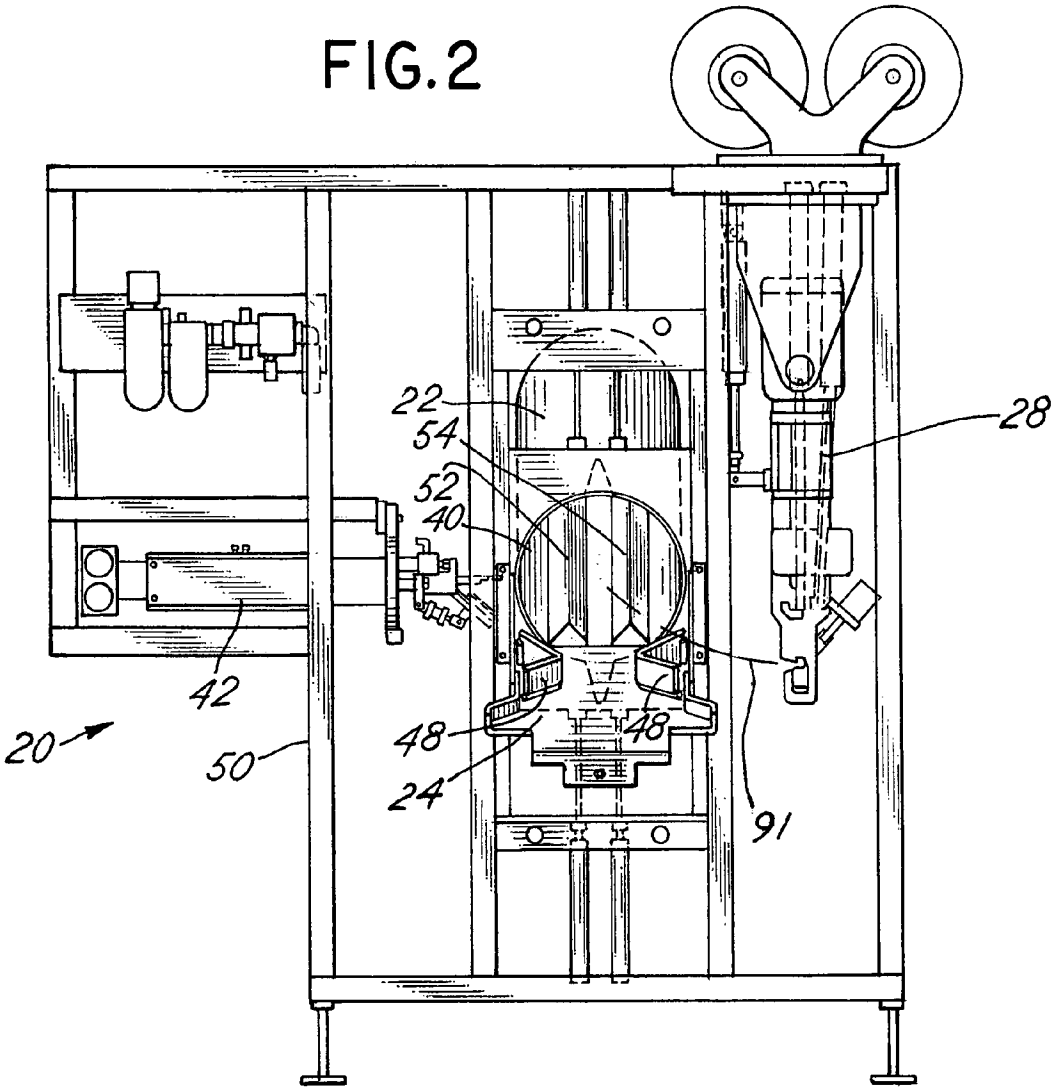
Figure 3:
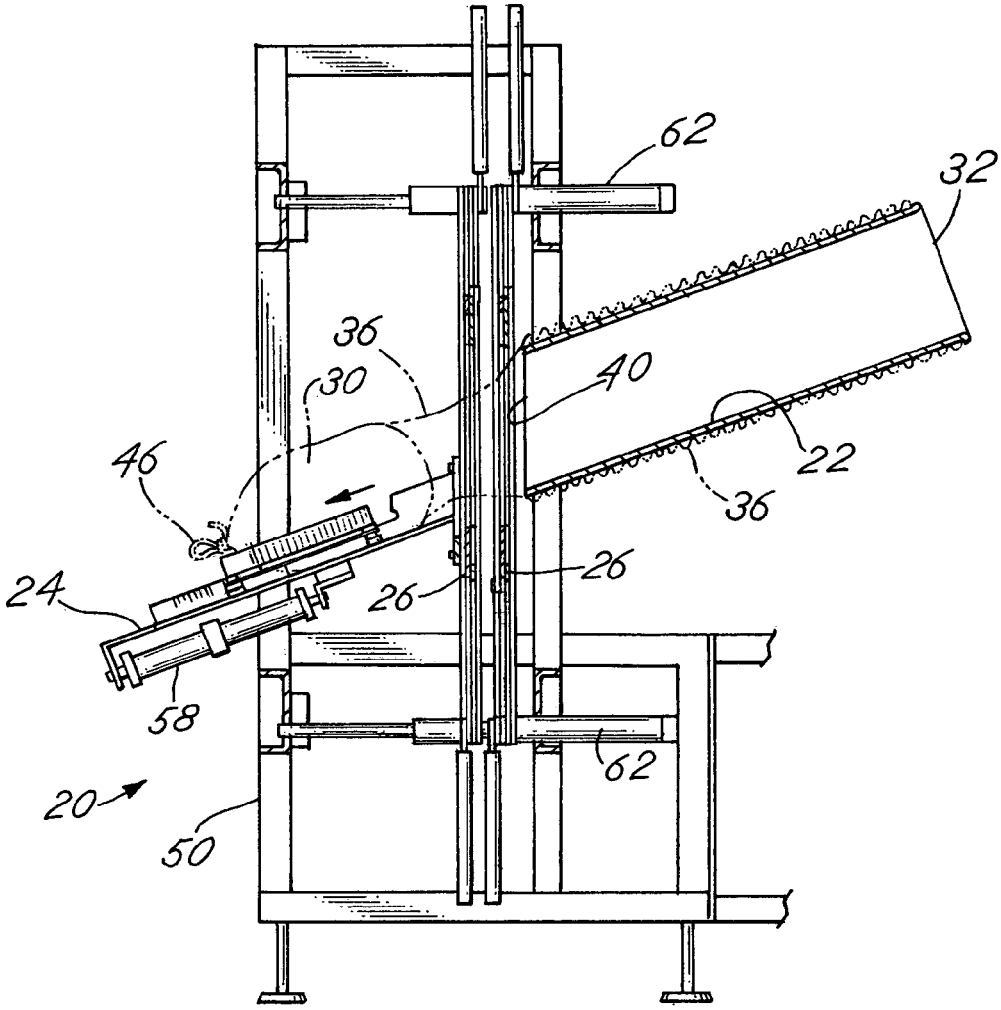
Figure 4:
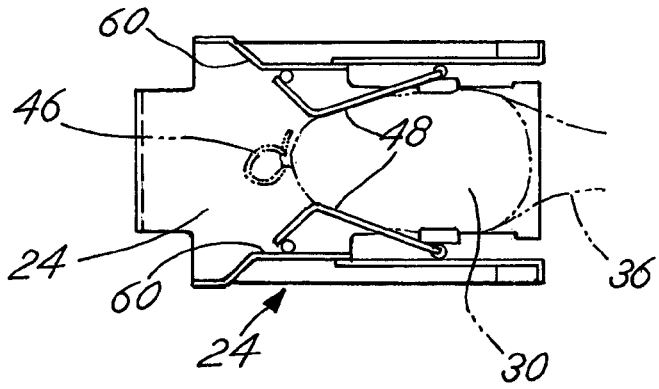
Figure 5:
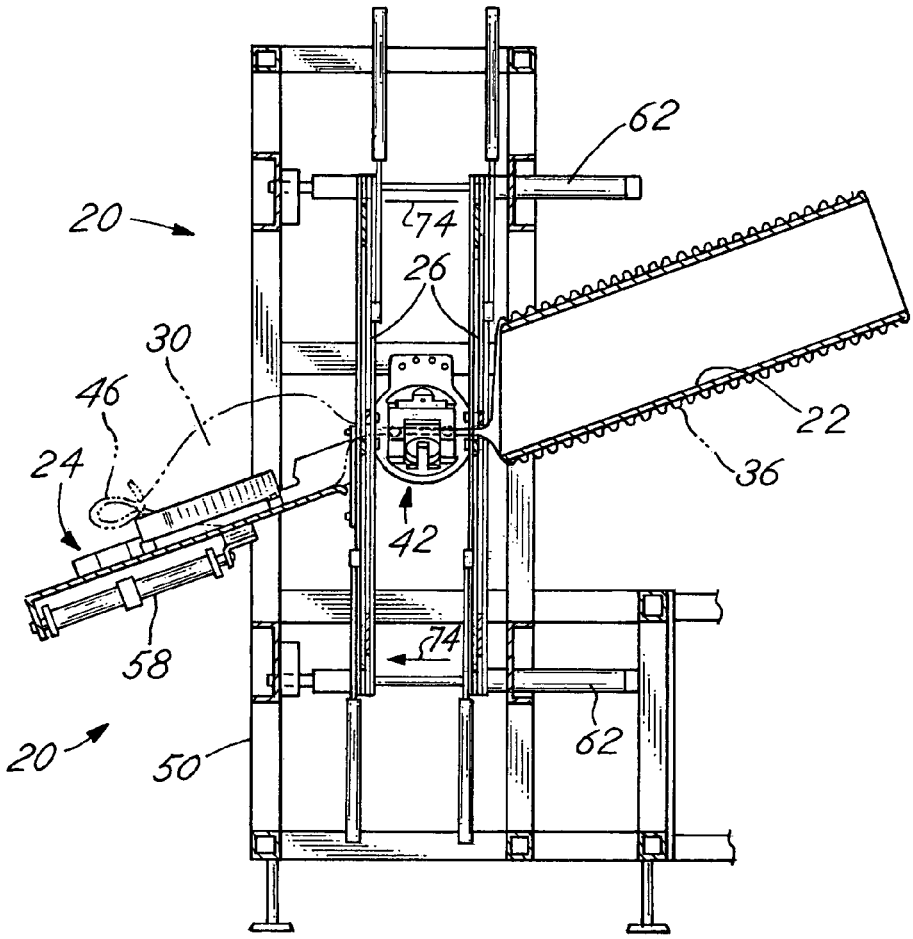
Figure 6:
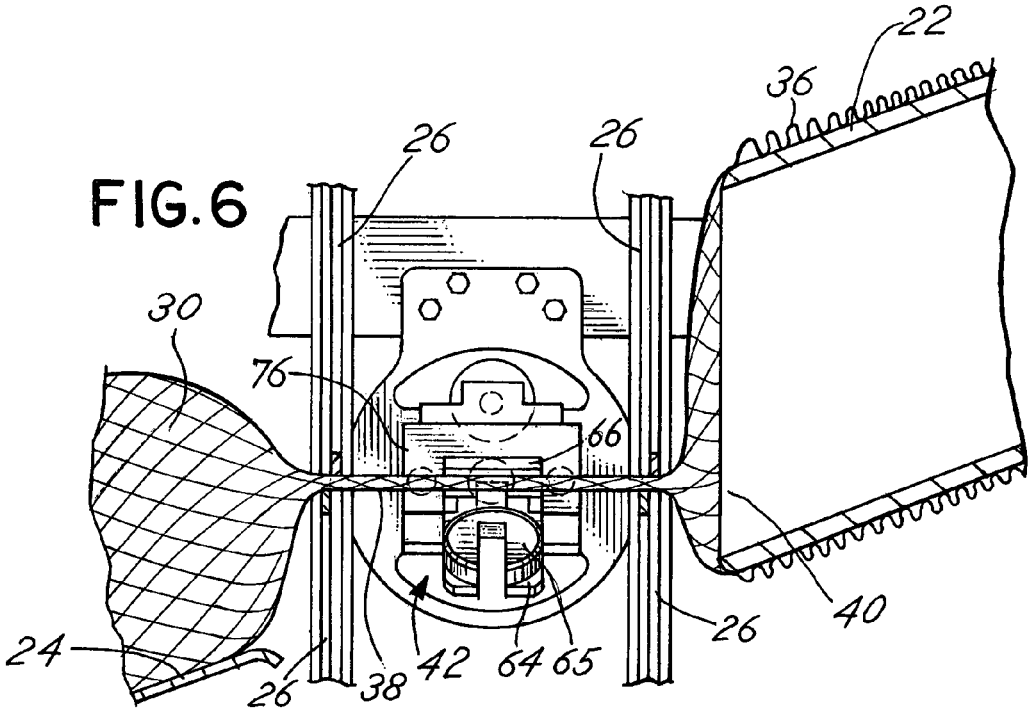
Figure 7:
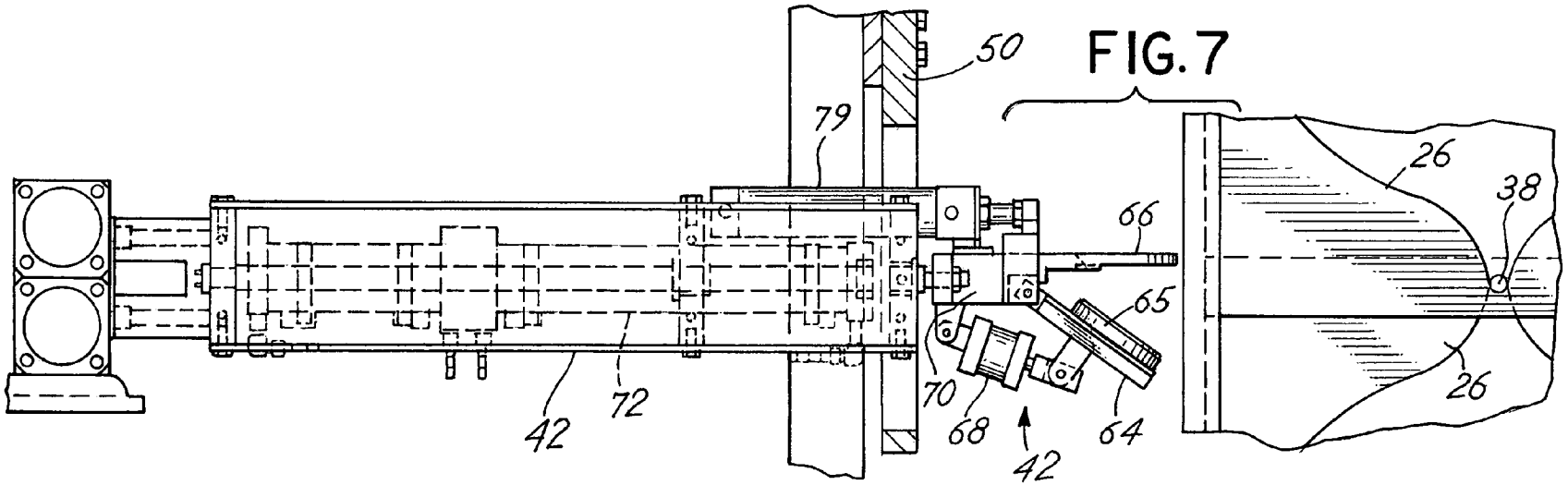
Figure 9:
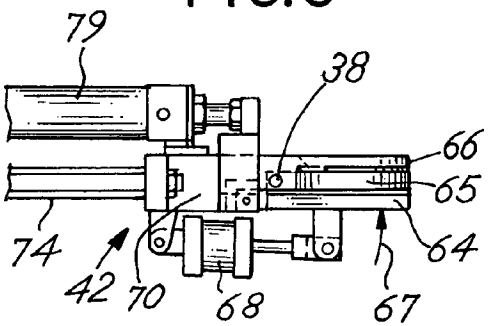
Figure 8:
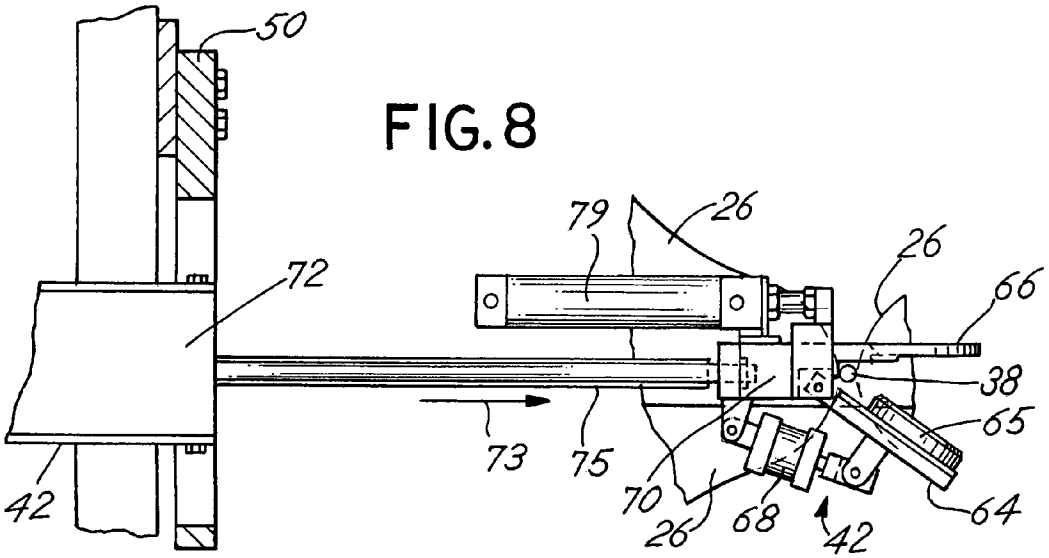
Figure 14:
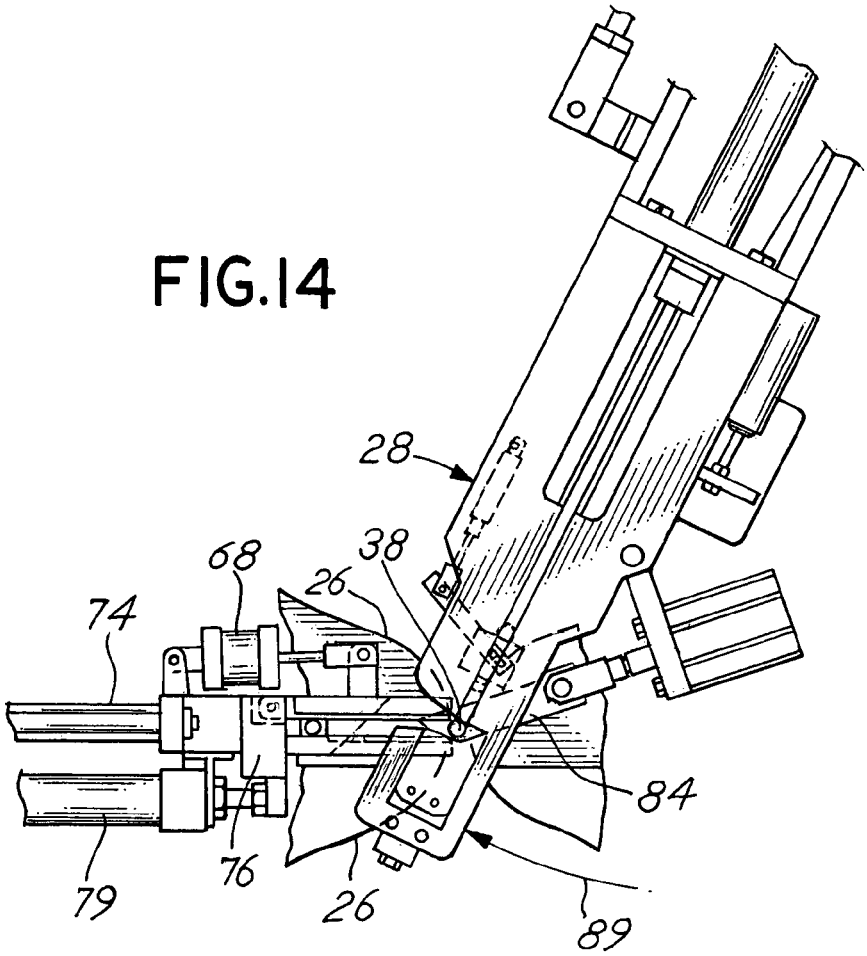
Figure 15:
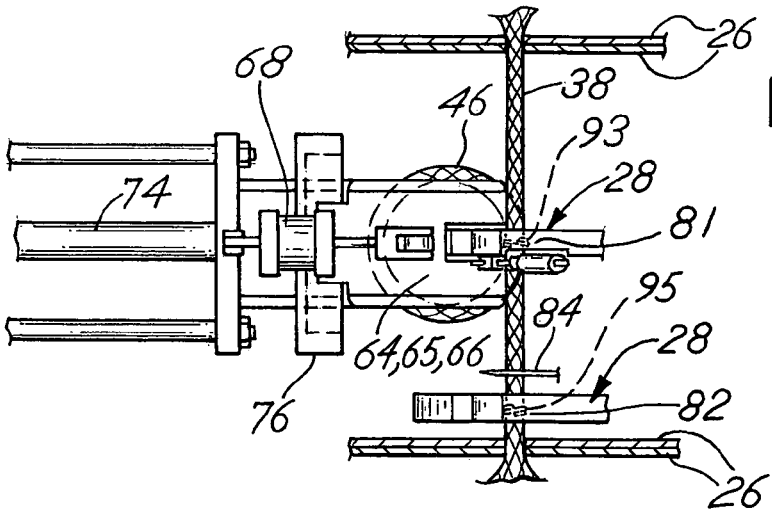
Figure 16:
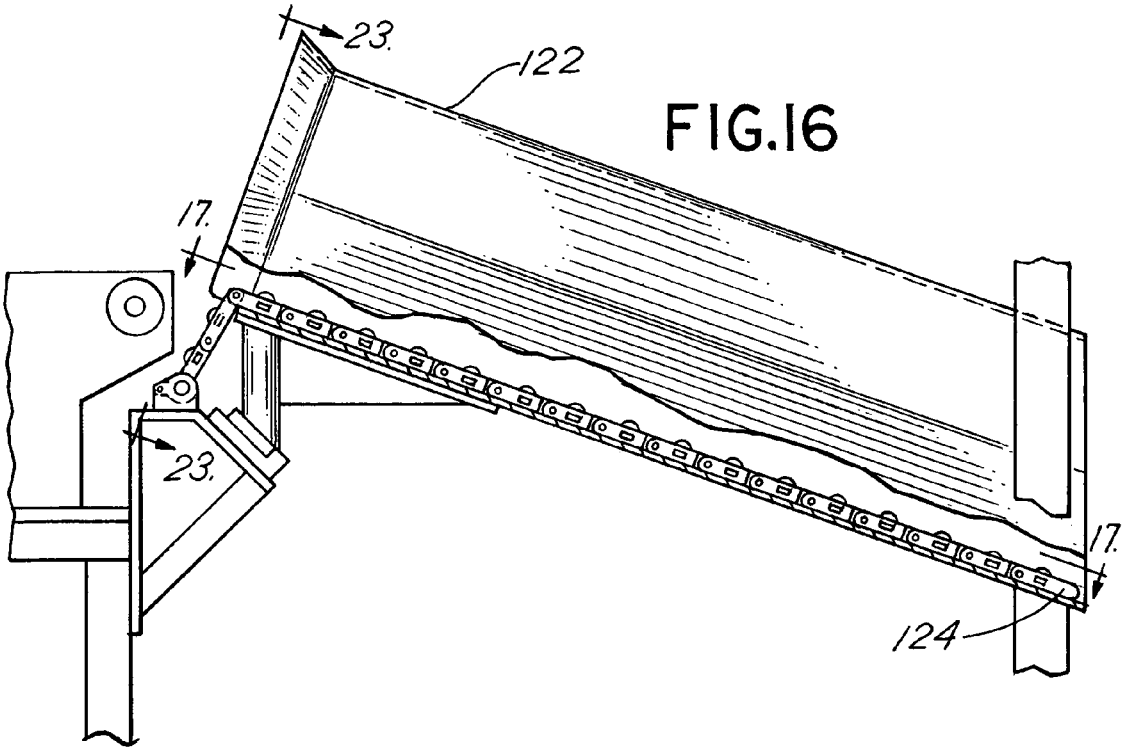
Figure 17:
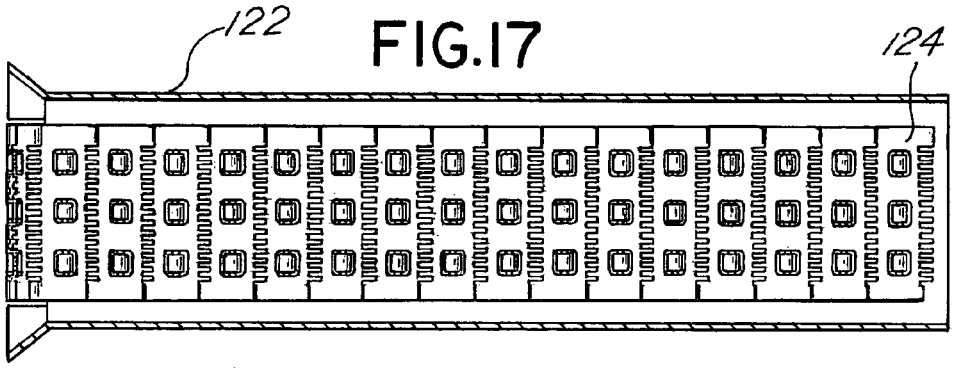
Figure 18:
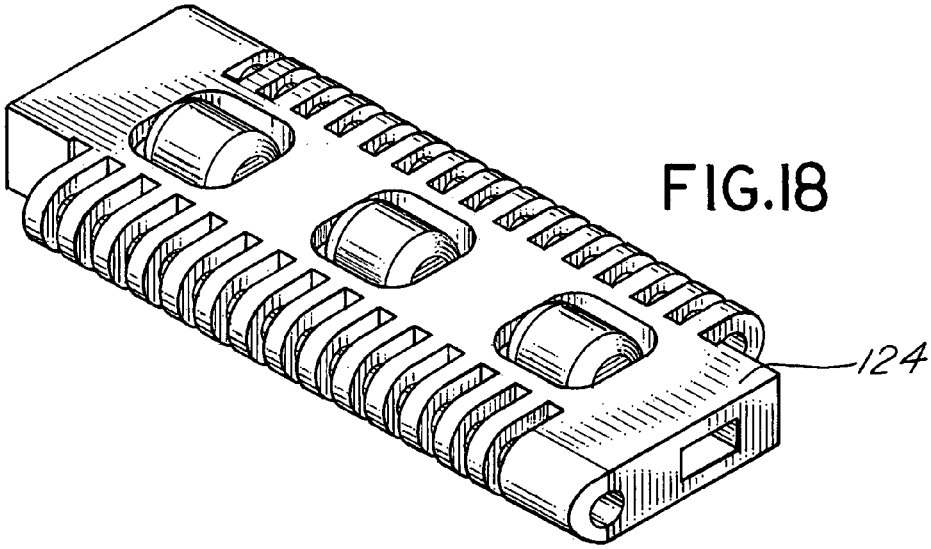
Figure 19:
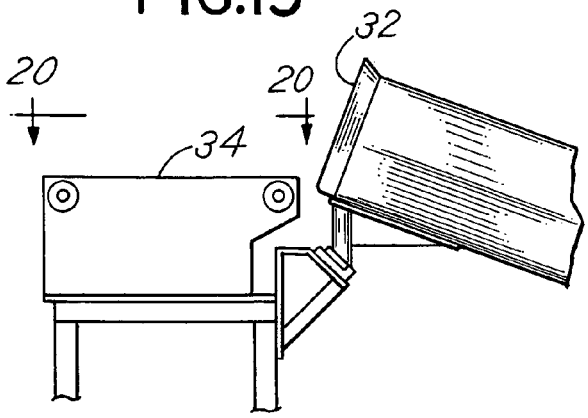
Figure 20:
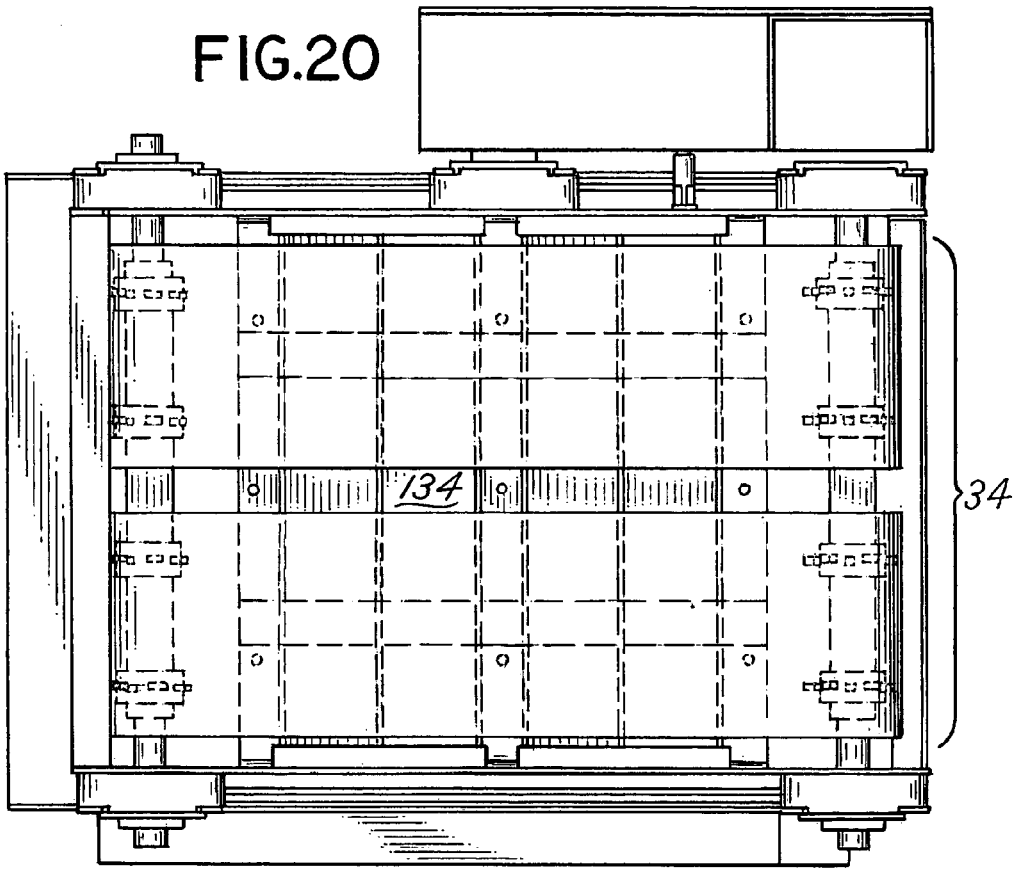
Figure 21:
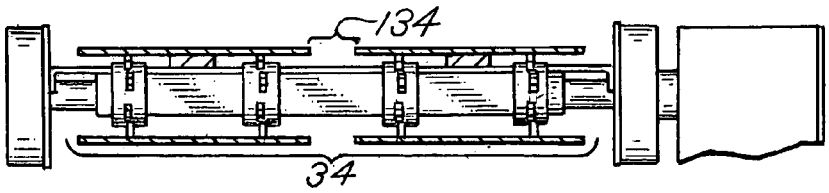
Figure 22:
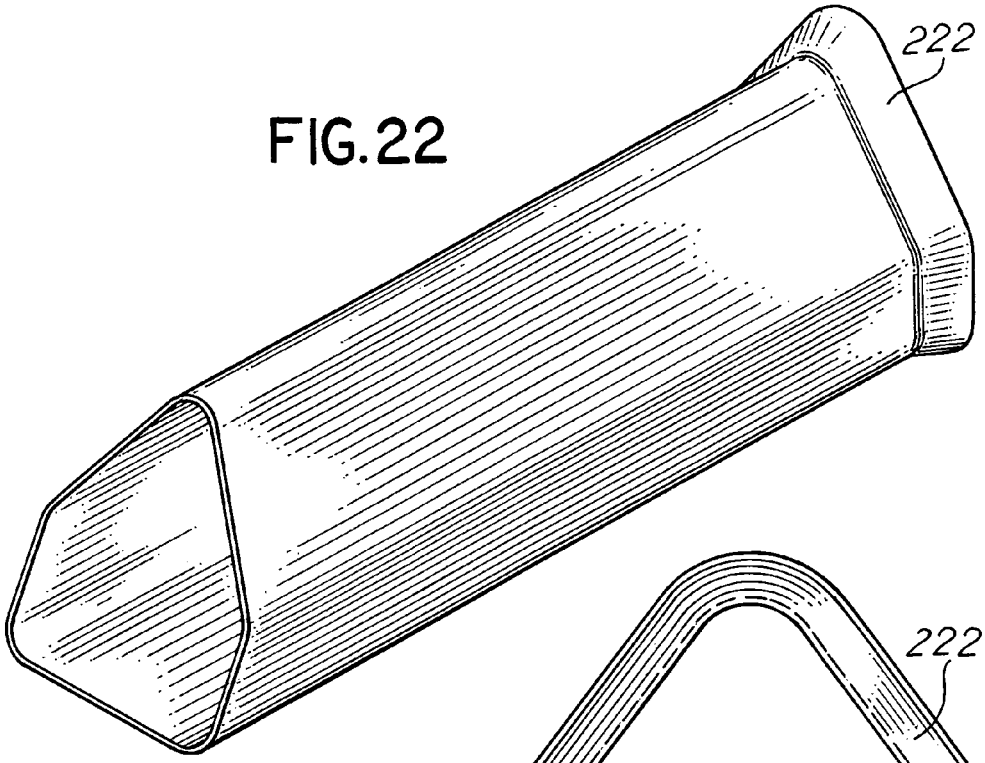
Figure 23:
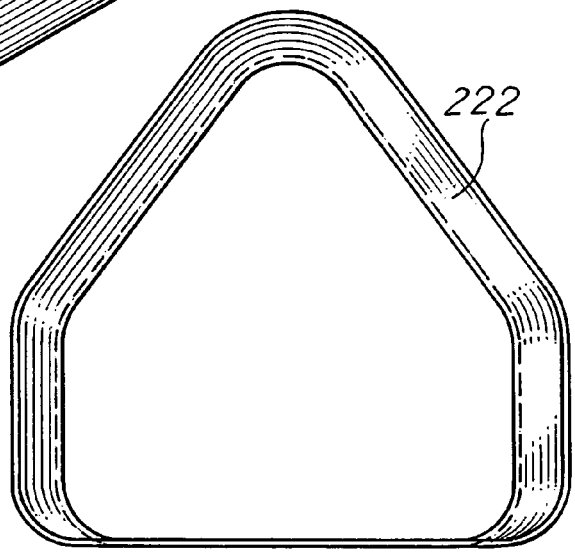

For orientation of the reader to the drawing, and for ease of beginning of reading of the following detailed description, a brief description of the drawing is as follows:

FIG. 1 is a side elevation view of the preferred machine of the preferred embodiment, from a primary operator's side, showing to the left a conveyor of the machine, showing centrally a chute of the machine, and showing to the right a clipper of the machine and the discharge end;

FIG. 2 is an end elevation view of the preferred machine of FIG. 1, from the discharge end of the machine, showing to the left a netting handle former of the machine, showing centrally the chute of the machine and a discharge platen, and showing to the right the clipper;

FIG. 3 is a partial side elevation and cross-section view of the machine of FIG. 1 from the opposite side from FIG. 1, with the chute and select frame members in cross-section, and with a product exiting the chute onto the platen without yet being clipped from behind;

FIG. 4 is a top plan view of the platen also seen in FIG. 2, in the area of the product shown in FIG. 3;

FIG. 5 is a side elevation view similar to FIG. 3, of the machine from the opposite side from FIG. 1, with the chute, platen and select frame members in cross-section, and with a product being tightened from behind by voiders and with the netting handle former poised to engage the netting behind the product;

FIG. 6 is an elevation view and enlargement of the area of the netting handle former of FIG. 5, with the product notably to the left, the chute end to the right, and voiders having voided the netting to the right and left of the netting handle former;

FIG. 7 is a partial end elevation view, from the discharge end of the machine, of the netting handle former, with the netting-engaging portions of the former to the center right of the figure and in a ready or retracted position and with the voiders to the far right;

FIG. 8 is an enlarged partial elevation view of the area of the netting handle former to the center right in FIG. 7, changed to reflect a first extended or engaging position of the former, in which the netting-engaging components are moved toward the voiders and engage the netting;

FIG. 9 is a partial elevation view of the former similar to the right side of FIG. 8, with the netting-engaging components of the former closed, as they would be in engaging the netting to begin to form a handle;

FIG. 10 is a top plan view of the netting-engaging components of the handle former, showing the netting in the same position as in FIG. 9;

FIG. 11 is a top plan view similar to FIG. 10, with the netting-engaging components in motion to the right and left, toward forming a handle in the netting;

FIG. 12 is an enlarged side elevation view similar to FIG. 6, showing the handle former's netting-engaging components having twisted a handle into the netting behind the product on the machine platen;

FIG. 13 is an elevation view similar to FIG. 9 with the netting handle formed as in FIG. 12;

FIG. 14 is an elevation view with the portion addressing the netting handle former similar to FIG. 13 and also with the clipper of the machine of the figures shown swinging in to clip and cut the netting;

FIG. 15 is a plan view similar to FIGS. 10 and 1 1, showing the netting handle formed and clipped, on the former, and being cut, to be released to complete the handle formation;

FIG. 16 is a side elevation view, partially cut away, of an alternative chute with roller in a link belt configuration;

FIG. 17 is a cross section taken along line 17—17 of FIG. 16;

FIG. 18 is a perspective view of a roller segment;

FIG. 19 is a partial side elevation view in the area of the chute receiving end 32;

FIG. 20 is a view taken from line 20—20 in FIG. 19;

FIG. 21 is a view from an end of FIG. 20, with the conveyor belting cut back to reveal detail;

FIG. 22 is a perspective view of a second alternative chute;

FIG. 23 is an end view of the chute of FIG. 22; and

Figure 24:
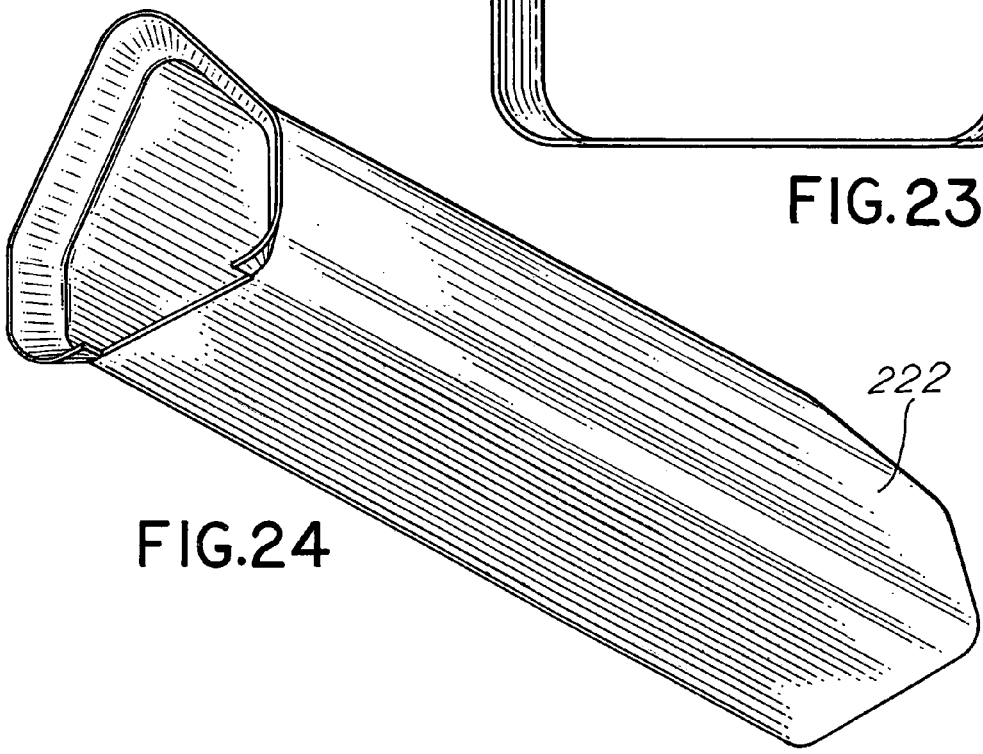

FIG. 24 is a further perspective view of the chute of FIG. 22.

DETAILED DESCRIPTION OF THE PREFERRED EMBODIMENT

The preferred product netting machine of the invention is a machine generally designated 20 in FIG. 1. The machine 20 comprises, in major part, a chute 22, a product receiver or platen 24, voiders 26 (not shown in FIG. 1; see FIG. 7), and a clipper 28. The chute 22 receives products 30, such as dressed turkeys, serially through a chute receiving end 32, as from a conveyor 34, and discharges them serially into netting 36 (not shown in FIG. 1; see FIG. 3) preferably rucked on the chute 22. The products 30 are manually placed on the conveyor 34. As each product 30 arrives at the product receiver or platen or tray 24, the voiders 26 operate to form a rope section 38 of the netting 36 (not shown in FIG. 1; see FIG. 6) behind the product 30, at the chute 22's discharge end 40. The clipper 28 also clips the netting, to complete the netting of the product, and clips and cuts the netting to create the starting end of the next netted product (see FIGS. 14 and 15). With a machine 20 as described, products are serially or successively netted and clipped. The mechanisms of the invention are under the control of a pneumatic controller, with operator input (not shown).

The machine 20 also includes a netting handle former 42. This former 42 operates to loop the rope section 38 (see FIG. 6) behind the product, before clipping, to form a looped handle 46 for a product 30 in the rope section 38 of the netting 36 (see FIGS. 3 and 10–15; see also below). The netting that is clipped behind the products is the netting 36 formed into the loops or handles 46, and thus, the clips that are put on by the clipper 28 secure the loops 46 in a consistent size and condition.

Also as in FIG. 1, the machine 20 has a number of valuable mechanisms, components and structures, mounted on a frame 50, a form of base. The product receiver is preferably a discharge tray 24, as indicated, inclined outward to discharge products, and there are product guides 48 on the tray 24 to straighten the product 30, align it for netting, and also to co-operate with the voiders 26 (see FIG. 7) to help tighten the product packaging. As another example, the clipper 28 also preferably is uniquely structured in its clip rails to contribute to tighter packaging. As a third example, the chute 22 is gravity driven and includes product ribs or rails 52, 54 (FIG. 2) for centering and ease of movement of products. As a fourth example, and as will be explained in more detail, the handle former 42 is an essentially two-part, mechanically actuated disc and clam shell construction that reaches for the netting, captures it, and rotates a loop into it, while tightening the packaging, in co-ordination with the voiders. Still further, the unit may be equipped with a weight scale in the area of the conveyor, to permit product weighing and tagging. To further the tagging, the machine may be equipped to print a tag as the product proceeds down the chute, to be fed under the clip and be clipped to the specifically weighed product.

In another aspect, then, the preferred embodiment constitutes a method of product netting. This method utilizes the preferred machine 20 and comprises automatically moving products 30 from a conveyor 34, serially, through a chute 22 into netting 36 to enclose the product 30 and begin the method of netting the product 30. The netting material 36 is voided behind the product 30 to form the rope section 38 as described with the machine 20, and the material 36 is clipped, also as described with the machine 20. The method includes forming the loop handle 46 of the rope section 38 and clipping the loop 46 to form a secure, looped handle for a product 30, and a tight net package for the product 30 as well.

The preferred embodiment also constitutes the netted, handled, clipped product 30, and such products that are also further weighed and tagged.

Referring again to FIG. 1, as seen from a primary operator's side, the chute 22 is centrally located, tilted downward from left to right, the product receiver or platen 24 is to the lower right, the voiders 26 are generally between the chute 22 and the platen 24, with the clipper 28, and the conveyor 34 is to the upper left. All components are mounted on the frame 50, such that the conveyor 34 and the opening 32 of the chute 22 are at an ergonomic working height. The frame 50 is raised above an uneven floor and leveled with adjustable feet as shown. The frame, chute, tray 24, and a variety of the associated mechanisms and components are made of stainless steel.

A calibrated weight scale 56 may be as shown to the far left. The conveyor 34 may be segmented, as in the two segments shown, or with one or three or more segments. Preferably, the center of the conveyor belt is void or absent of any belting material, to provide a centering or alignment slot or groove 134 on the conveyor 34 for the product, as in FIGS. 19–21. This slot assists in the resistance to side to side movement of the product.

The chute receiving end 32 of the chute 22, and the whole of the chute 22, are preferably aligned with the conveyors so as to generally extend in a common direction. The chute 22 is, of course, tilted and gravity actuating, while the conveyor 34 is level and motorized. Movement of the conveyor 34, after weighing or otherwise when ready, by manual, semi-automatic, or time-based or other automatic actuation, causes the products 30 to reach the chute receiving end 32 and move into the upper chute end 32, serially or one at a time. The product ribs 52, 54 extend substantially throughout the chute 22, from its receiving end 32 to its discharge end 40, aligned with the common direction of the chute 22 and conveyor 34, and spaced from each other across the bottom centerline of the chute 22. The ribs 52, 54 also contribute to the centering of the product, to resist moving or turning except for movement straight down the chute. The ribs thereby enhance centering of the product in the netting and formation of the handle along the centerline of the product. The ribs 52, 54 are most preferably made during bending to create the chute. The resulting ribs have curved upper, lengthwise tips and are finished at the upper and lower ends with sloped ends as in FIG. 2 to prevent any sharp edge contact with the products.

As with a variety of past machines, the netting 36 is readily manually rucked on the chute 22. Access may be provided by removable and swinging mounting of components to permit manual access to the chute. The input end 32 is also accessible for rucking. Once the netting is rucked, it may also be manually pulled on start-up into the area of the clipper 28 and voiders 26, with appropriate safety precautions. For a first product, a handle may be pre-placed on the downstream end of the netting 36.

Products 30 on the conveyor 34 that have moved down the chute 22 move into the netting 36 as the product and the netting that is driven by the product exit the chute. The product continues under gravity onto the tray 24, as in FIGS. 3–4, sliding into contact of the netting and the product with the product guides 48. The guides 48 are driven by a double air cylinder, back-to-back cylinders 58 (FIGS. 1 and 3). Referring to FIG. 4, which is a plan view, or view from above, the guides 48 are movable up and down the tray 24 under the action of the cylinders 58 and two tracks 60. The guides 48 include outward flanged lower ends. The tracks 60 for the guides 48 are preferably fixedly mounted on the tray 24, outward of the guides 48. The lower ends of the tracks 60 slope downward and outward to an increased width, and the upper ends are parallel to the direction of product movement. The upper ends have a narrower width between each other than at the lower ends, while also being wider than the width of products. Under action of the cylinders 58, and pivoting against the tracks 60 under the weights of the products 30, the guides 60 thereby move among three primary positions, a ready position, an up position, and a discharge position. The up position is as shown in FIG. 3. In the ready position, the guides are spaced such that products gravity fed into them stop at them. In the up position, as in FIG. 3, the guides are moved upward to assist in using any slack netting in the action of the voiders. The guides 60 are moved to the up position in advance of the action of the voiders. After clipping and cutting, the guides 48 are moved downward and under product weight, outward against the lower, wider ends of the tracks 60 to release finished products.

Products 30 on the conveyor 34 that have moved down the chute 22, into the netting 36, onto the tray 24, and into the product guides 48, have the guides 48 move upward and angle inward, holding the products securely with a slight upward movement. Once this happens, the voiders 26, netting handle former 42, and clipper 28 become active. The voiders comprise multiple plates under the action of multiple cylinders such as voider cylinders 62 (FIGS. 3 and 5). As can be seen by comparing FIGS. 3 and 5, and noting arrows 74, the voider plates occupy two closely spaced left to right spaced positions in FIG. 3, and two more distant left to right spaced positions in FIG. 5. As in FIG. 3, the voiders 26 are in a closely spaced, ready position when the product arrives for finishing. Under action of the cylinder 62, the downstream voiders are moved further downstream, in the direction of the tray 24. At the same time, or in advance or following, the voider plates 26 are moved inward toward the netting across the direction of product movement, behind the "trayed" product 30 under the action of other cylinders. The resulting voider positions are as in FIGS. 5, 7, 8 and 12–15. In this "active" position, the voider plates 26 are tight around the netting 36, in spaced voider sets, to define the voided, tight, rope section 38 of the netting 36. This situation is best shown in FIG. 6. There, the voider sets 26, 26 are spaced as in FIG. 5, separating the trayed product 30 and the chute 22, and exposing the rope section 38 to further action of the now-visible netting handle former 42.

As above, the handle former 42 is an essentially two-part, mechanically actuated disc and clam shell construction that reaches in after action of the voiders causes the conditions of FIG. 6. The former 42 reaches in for the rope section 38 of the netting, captures the rope section 38, and rotates a loop into the rope section 38, while tightening the netting on the trayed product 30. Referring to FIGS. 1 and 2, the body of the former 42 preferably extends transversely to the direction of product movement through the machine 20. The frame 50 has an upper extension to the left in FIG. 2 for the former 42.

Referring to FIG. 7, and also again to FIG. 6, the disc and clam shell construction includes a disc and clamshell halves 64, 66. The upper clamshell half 66 extends generally horizontally, transversely, and the lower clamshell half 64 with the disc 65 is below the upper half 66. The lower clamshell half 64 and disc 65 are pivotably mounted to a clamshell cylinder 68 that is in turn mounted to a former support 70. The upper half 66 is also mounted to the support 70. Comparing FIGS. 7 and 8, the disc and clamshell halves are movable together reciprocally, transversely, toward and away from the voiders 26, under action of a former driver cylinder 72 as in arrow 73 through extension and retraction of a shaft 75. Comparing FIGS. 8 and 9, the disc and clamshell halves 64, 66 are movable together and apart, around a pivot at a right angle to the transverse direction, as a result of movement of the lower clamshell half 64 and disc 65 under reciprocating action of the cylinder 68.

Referring again to FIGS. 6 and 7, the disc and clamshell parts occupy a ready condition with the disc and clam shell being remote transversely from the voiders. Longitudinally, i.e., in the direction of product movement, the disc and clam shell are positioned to be between the voider plates when the voider plates separate longitudinally and create the netting rope section as in FIGS. 5 and 6.

Referring now to FIG. 8, when the rod 75 advances, the disc and clam shell move to the voiders 26 and cause the rope section 38, which is stable, to enter deeply between the disc and clamshell, to a position as in FIG. 8. In this position, the rope section 38 is behind the disc 65, on the distal side of the disc 65, i.e., the side of the disc farthest from the voiders when in the ready position.

Referring to FIG. 9, under action of the cylinder 68, after advancement to the position of FIG. 8, the clamshell halves are closed as in arrow 67 and the netting rope section 38 is captured in the clam shell behind the disc 65. FIG. 10 shows this condition in plan view. Comparing FIGS. 10 and 11, in a next stage of operation of the former, a rope section guide or stripper plate 76 is next advanced, transversely. As in FIG. 11, the guide 76 slides toward the rope section 38 over and along the closed clamshell halves. The guide 76 is driven by a cylinder 79 as in arrow 81. The guide 76 directs the rope section 38 around the sides of the disc 65 at areas 78, 80. Simultaneously, the disc and clamshell retract, under retracting action of the shaft 75 as in arrow 83. The result is that the disc 65, wrapped by the rope section 38 on three sides, extends behind the guide 76 to the left and away from the voiders, as shown in FIG. 11. The forward face of the disc is generally even with the forward face of the guide or plate 76. The slack behind the trayed product is taken up, in part.

The formation of the loop handle 46 is then completed. Referring to FIG. 12, the disc and clamshell, and the plate 76, rotate a half circle or one hundred eighty degrees, about the transverse axis of the shaft 75. A rotary drive is included for this purpose, as in FIG. 7. The slack is further taken up. As seen in FIG. 12, once the disc and clamshell rotate as in arrows 83, 85, the forward area of the rope section 38 includes two overlapped portions of the rope section. The stripper plate 76 is then retracted as in arrow 87. With the clamshell remaining closed, as in FIG. 14, the clipper 28 moves in, as in arrows 89, 91 (FIG. 2) and places a clip 93 on the two overlapped portions of the rope section, and a second downstream clip 95 on the back side of the trayed product, as at clipper die locations 81 and 82, in FIG. 15. A knife 84, on the clipper body, is located between the two locations of clipping. The knife 84 cuts the rope section between the clips, finishing the trayed product and forming the loop handle 46 for the next product.

As indicated, the clipper 28 clips the netting, to complete the netting of the product, and clips and cuts the netting to create the starting end of the next netted product. The clipper has a flush side. This allows the clipper to be placed in the relatively tight location of the machine 20. Unconventionally, a clip rail normally on one side is located to the opposite side, such that from one side, two clip rails feeds clipper mechanisms on both sides of the clipper. To accommodate the second clip rail on the common side, the second clip rail is angled into the opposite side anvil location and the second clip rail passes through the clip die support structure of the other clip die and anvil. The opposite side clip groove is straight. The other clip rail, that is straight, feeds an angled clip groove. Thus, the angle between clip rails and clip grooves is the same for both clip mechanisms. The clipper dies are ribbed for columnar support, with the ribs turned toward the same side of the clipper. With a machine 20 as described, products are serially or successively netted and clipped.

The handle former thus includes a loop former movable to engage the rope section, draw the engaged rope section to create a loop-length of the rope section, and twist the engaged, drawn, loop-length of rope section to form a loop. The handle former further includes motive means on a base, as for example, in the nature of the described cylinders, for moving the loop former to engage, draw, and twist the rope section.

The rope section defines a line of movement of the rope section. The loop former is movable transversely of the line to extend past the rope section and engage the rope section on retraction. The loop former is retractable transversely to draw the rope section. The loop former is also rotatable around an axis skewed from the line to twist the rope section, to form the loop. The handle former further includes motive means on the base for moving the loop former transversely of the line, and rotatably around an axis skewed from and perpendicular to the line of movement. The motive means is functional to overlap two spaced segments of the rope section while forming a loop between the spaced segments.

The loop former includes a disc with an outer perimeter to form the loop around the outer perimeter of the disc, and an openable and closable clam shell including the disc. The motive means is further for moving the disc linearly transversely to the line, and for allowing the disc to move past the rope section and then engage the rope section with the loop forming around the outer perimeter of the disc on retraction of the loop former.

With the mechanisms of the machine 20 driven by pneumatic cylinders as described, and with the timing of the cylinders set automatically, the machine 20 applies netting to products essentially automatically, reliably, and at high speed, where the products include whole turkeys, hams, shellfish, and similar items in a variety of industries. With extra mechanisms including a tag printer and a mechanism to feed printed tags under a clip, the machine 20 weighs, tags, bags, and provides consistently sized consumer handles for better-looking finished products, in series, in a safe and efficient netting machine.

The machine 20 is easily operated by one person, capable of use with a large assortment of netting, and may be provided with all electronic controls. The machine 20 may be constructed of stainless steel, may meet USDA requirements, is suitable for harsh environments, and is washable for sanitation. The machine 20 most preferably comprises a sensor for sensing a product on the product receiver and actuating the voiders and clipper, and a sensor for sensing a product on the product receiver and actuating the voiders, clipper and netting handle former. Automatic indexing of the conveyors, once product weight has been calculated, greatly increases the throughput of the machine. Conventional sensors are contemplated.

As can be observed, the method of product netting employed by the machine 20 comprises several steps. A product is moved through a chute into netting to enclose the product with the netting. The enclosed netting is voided to form a rope section of the netting between the product and the chute. The rope section is clipped. With these steps, successively netted and clipped products may be formed by the method of the machine. The method also comprises, as described, forming a netting handle by forming a loop of the rope section to form a looped handle in the rope section of the netting. Netted products are thereby formed with netting handles. The clipping of the rope section is clipping of the looped rope section to secure the handle.

With the most preferred controls, a product is placed on the weight scale conveyor. The weight settles for a specified time dependent on the weight scale. The scale then sends a signal to a product tag or label printer. After the tag is printed, the conveyors index the product to the staging conveyor at the receiving end of the chute, while the handle is formed for the incoming product and the tag is attached to the netting. As the indexing takes place, an ultrasonic sensor on the staging conveyor confirms the presence of the product. This sensor both (a) stops the indexing of the conveyors, and (b) prevents loss of relationship between a tag and a product by sensing product removal, and causing a fault.

While the indexed product is on the staging conveyor, another product is loaded on the scale conveyor. Once the scale settles on the second product, indexing occurs again, sending the first product down the chute. The first product is clipped from behind and the next loop is formed with the second tag. A last product button is available and manually pushed to advance the last product without need of a scale reading, signal to a printer, or tag printing.

As most preferred for some applications, the machine has the ribs 52, 54 continue onto the platen, where the product rests as the handle is made and clips are applied. Also, between the chute and voiders, the machine provides an air blast that actuates after the clips are applied, to the end of the trayed product and the beginning of the next product. The air blast holds the "next" handle off the discharge platen and keeps it centered as the next product is formed by a product unit arriving down the chute. The air blast also keeps the handle from being caught in the voider plates when the machine begins a new operational cycle.

Referring to FIGS. 16–18 and 22–24, alternative chutes 122 and 222 are contemplated. Chutes 122 and 222 are both appropriate for ham applications. The simpler alternative, chute 222, incorporates a flat bottom with a baked on Teflon™ coating throughout the interior of the chute. The coating reduces friction between the product package and the inner chute surface. The more mechanically complex chute 122 incorporates a series of rollers nested in a link belt configuration and attached adjacent to the entrance end of the chute 122. The rollers in segments such as roller segment 124 aid in the transfer of the product while the links serve as a roller mounting medium. To optimize the chutes for ham applications, the chutes are shaped in their cross sectional profile to closely resemble the cross sectional shape of the products, as in FIGS. 22–24. The chute profile provides for a netting that is sized to be close to the end-package configuration. This results in a tighter finished package. The profile of FIGS. 22–24 is used with both chute 122, with rollers, and chute 222, with Teflon™ surface material.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A product netting machine comprising:

a base;

a chute on the base having a receiving end for receiving products, and a discharge end for discharging products, the chute including a netting rucker to receive netting rucked on the rucker, and to permit netting to move with discharged products from the discharge end;

a product receiver on the base at the discharge end of the chute;

voiders on the base operated to form a rope section of the netting between the product receiver and the discharge end of the chute when a discharged product is on the product receiver;

a clipper on the base operated to clip the rope section of the netting; and a netting handle former on the base operated to loop the rope section to form a looped handle in the rope section of the netting, whereby successively netted and clipped products are formed by the product netting machine, the handle former including a loop former movable to engage the rope section, movable to draw the engaged rope section to create a loop-length of the rope section, and movable to twist the engaged, drawn, loop-length of rope section to form a loop, and for a rope section defining a line of movement of the rope section, the loop former movable transversely of the line to extend past the rope section and engage the rope section on retraction, the loop former retractable transversely to draw the rope section and the loop former rotatable around an axis skewed from the line to twist the rope section, to form the loop; and the handle former further including motive means on the base for moving the loop former transversely of the line, and rotatably around an axis skewed from the line.

2. A product netting machine as in claim 1, the motive means for moving the loop former rotatably around an axis perpendicular to the line, to overlap two spaced segments of the rope section while forming a loop between the spaced segments.

3. A product netting machine as in claim 2, the loop former including a disc with an outer perimeter to form the loop around the outer perimeter of the disc.

4. A product netting machine as in claim 3, the motive means further for moving the disc linearly transversely to the line, for allowing the disc to move past the rope section and then engage the rope section with the loop forming around the outer perimeter of the disc on refraction of the loop former.

5. A product netting machine as in claim 4, the loop former further including an openable and closable clam shell including the disc.

6. A product netting machine as in claim 1, further comprising product guides on the base associated with the product receiver.

7. A product netting machine as in claim 6, the product guides being pivotally mounted for engaging and disengaging products on the product receiver.

8. A product netting machine as in claim 6, the product guides mounted on opposite sides of the discharge end of the chute.

9. A product netting machine as in claim 6, the product guides holding the product adjacent the voiders.

10. A product netting machine as in claim 1, further comprising means for sensing a product on the product receiver and actuating the voiders and clipper.

11. A product netting machine as in claim 1, further comprising means for sensing a product on the product receiver and actuating the voiders, clipper and netting handle former.

12. A product netting machine as in claim 1, in which the chute is gravity driven and includes product ribs or rails for centering and ease of movement of products.

* * * * *